US006151476A

United States Patent [19]

Tsuruya et al.

[11] Patent Number: 6,151,476

[45] Date of Patent: Nov. 21, 2000

[54] DUAL MODE IMAGE FORMING APPARATUS

[75] Inventors: Takaaki Tsuruya, Mishima; Akihiko Takeuchi, Susono; Toshiaki Miyashiro, Shizouka-ken; Takehiko Suzuki, Numazu, all of Japan

[73] Assignee: Canon Kabushiki Kaisha, Tokyo, Japan

[21] Appl. No.: 09/300,522

[22] Filed: Apr. 28, 1999

[30] Foreign Application Priority Data

Apr. 28, 1998 [JP] Japan ..... 10-119285

[51] Int. Cl.[7] ..... G03G 15/01; G03G 15/16

[52] U.S. Cl. ..... 399/302; 399/297; 399/308

[58] Field of Search ..... 399/297, 298, 399/302, 314, 311, 308, 310

[56] References Cited

U.S. PATENT DOCUMENTS

| | | | |
|---|---|---|---|
| 5,153,654 | 10/1992 | Yuminamochi et al. | 399/318 |
| 5,177,549 | 1/1993 | Ohtsuka et al. | 399/320 |
| 5,179,397 | 1/1993 | Ohzeki et al. | 347/140 |
| 5,196,885 | 3/1993 | Takeuchi et al. | 399/168 |
| 5,214,480 | 5/1993 | Aoki et al. | 399/314 |
| 5,287,163 | 2/1994 | Miyashiro et al. | 399/66 |
| 5,390,012 | 2/1995 | Miyashiro et al. | 399/303 |
| 5,508,796 | 4/1996 | Sasame et al. | 399/18 |
| 5,519,475 | 5/1996 | Miyamoto et al. | 399/308 |
| 5,523,829 | 6/1996 | Miyashiro et al. | 399/396 |
| 5,539,507 | 7/1996 | Miyashiro et al. | 399/298 |
| 5,899,610 | 5/1999 | Enomoto et al. | 399/302 |
| 5,983,060 | 11/1999 | Namekata et al. | 399/297 |

FOREIGN PATENT DOCUMENTS

| | | |
|---|---|---|
| 1-105980 | 4/1989 | Japan . |
| 5-303310 | 11/1993 | Japan . |

*Primary Examiner*—Susan S. Y. Lee
*Attorney, Agent, or Firm*—Fitzpatrick, Cella, Harper & Scinto

[57] ABSTRACT

An image forming apparatus has an image bearing member, an intermediary member and a voltage applicator to electrostatically to transfer the toner image from the image bearing member onto the intermediary transfer member and then transfer the image onto a transfer material. The apparatus is operable selectively in a first mode in which toner images of different colors are sequentially and superposedly transferred from the image bearing member onto the intermediary transfer member by the voltage application, and in a second mode in which only a toner image of a first color of the different colors is transferred onto the intermediary transfer member from the image bearing member. An absolute value of the voltage applied to the intermediary transfer member by the voltage applicator is larger when the second mode is selected than when the first mode is selected, when the toner image of the first color is transferred from the image bearing member onto the intermediary transfer member.

23 Claims, 6 Drawing Sheets

(a)

(b)

DUAL MODE IMAGE FORMING APPARATUS

FIELD OF THE INVENTION AND RELATED ART

The present invention relates to an image forming apparatus such as a copying machine, a printer or a facsimile machine, wherein a toner image this transferred from an image bearing member onto an intermediary transfer member.

There are known various types of image forming apparatus such as electrophotographic apparatus, thermal transfer type apparatus, ink jet type apparatus or the like. Among them, the electrophotographic apparatus is advantageous in that the speed and the quality of the image are high, and the noise level is low.

There are various types in the electrophotographic apparatus. For example, in one type, color images are superposed on a surface of an image bearing member, and are altogether transferred onto a transfer material (superposed development type). In another type, the development and image transfer are repeated (superposed transfer type). In a further type, developed toner images of different colors of are sequentially transferred onto an intermediary transfer member, and then, they are altogether transferred onto a transfer material (intermediate transfer type). Among these types, the intermediate transfer type has been particularly noted since the possibility of color mixing is low, and also since it is usable with various types of transfer materials.

Referring first to FIG. 8, there is shown an example of a conventional intermediate transfer type image forming apparatus.

The image forming apparatus comprises an electrophotographic photosensitive member (photosensitive drum) 1 of rotatable drum type of OPC (organic semiconductor) material. The photosensitive drum 1 is rotated in addiction indicated by an arrow a, and during the rotation, the surface thereof is uniformly charged by the charging roller 2, and then the surface is exposed to image light (image information) emitted from a laser diode 3*a* of an exposure apparatus 3 and reflected by a reflection mirror 3*b*, so that an electrostatic latent image is formed on the photosensitive drum 1.

The apparatus further comprises a rotary member 4A rotatably supported on the developing apparatus 4, which carries a magenta developing device 4*a*, a cyan developing device 4*b*, a yellow developing device 4*c* and a black developing device. A selected to one of the developing device (magenta developing device 4*a*) is brought to be faced to the photosensitive drum 1 to deposit the toner to the electrostatic latent image, thus developing it into a magenta toner image.

The magenta toner image is transferred onto an intermediary transfer belt which is driven by a primary transfer roller 6 at a primary transfer station. The intermediary transfer belt 5 is stretched around a driving roller 5*c*, a secondary transfer roller 5*b* and a tension roller 5*a*, and is urged to the photosensitive drum 1 by the primary transfer roller 6. The residual toner remaining on the photosensitive drum 1 after the primary image transfer is removed by a photosensitive drum cleaning device 10.

The above described charging, image exposure, development, primary transfer and cleaning operations are executed for the other colors, so that four color toner images are superposed on the intermediary transfer belt 5.

The triboelectric charge amounts of the color images (amounts of electric charge per unit weight) is made uniform by a corona charger 20, and then, the color toner images are altogether transferred onto a transfer material at a secondary transfer station having to the transfer rollers 5*b* and 7. The transfer material having now received the toner image (secondary transfer) is fed to an image fixing device 9, where the four color images are heated and pressed so that they are affixed, and the transfer material is discharged.

The toner remaining on the intermediary transfer belt 5 is removed by an intermediary transfer belt cleaning device 8.

Magnetic toner among the toner materials used in the developing device 4 of the image forming apparatus, comprises stylene acrylic resin material in which magnetite is dispersed. Therefore, it provides relatively less chromatic images. In view of this, when the caller image is formed using one component developer, the use is made with non-magnetic toner not containing magnetic material.

One of the recent demands is that a color image forming apparatus is used as a monochromatic printer, and the monochromatic printing is effected at low cost. To meet such a demand, non-magnetic toner having high chromaticity is used for yellow, magenta and cyan development, whereas magnetic monochromatic toner for monochromatic image forming apparatus is used for black development.

In the intermediate transfer type, the yellow, magenta, cyan and black images are sequentially transferred, and then, they are altogether transferred onto the transfer material (secondary transfer). The amounts of the triboelectric charge is different between the magnetic toner and the non-magnetic toner, more particularly, the triboelectric charge of the magnetic toner is lower than the other.

Therefore, conventionally, the use is made with a corona charger at the position before the secondary transfer to reduce the difference in the amounts of the triboelectric charge of the toners.

The following method has been proposed as a method of removing the residual toner from the intermediary transfer belt 5. After the secondary transfer, the residual toner remaining on the intermediary transfer belt 5 is electrically charged to a polarity opposite from the charging polarity of the regular toner in the developing device. The residual toner thus charged is transferred back to the photosensitive member in the primary transfer station, and simultaneously therewith, a first toner image formed on the photosensitive term for the next original is transferred. In this case, the primary transfer roller is supplied with a predetermined voltage, a latitude of which is narrow in order to satisfy both of the reverse transfer and the primary transfer. Therefore, a high-voltage could not be applied.

However, corona discharges produces ozone which may deteriorate the image quality, and requires a quite expensive high-voltage circuit for the corona charger.

It has been proposed that when the toner images are sequentially transferred onto the intermediary transfer member, the black toner image is first transferred, wherein the black toner is given the electric charge upon the voltage application in the primary transfer station for the second and subsequent transfer during the full color image formation, by which the triboelectric charge amounts of the magnetic toner and the the non-magnetic toner are the same.

However, when a monochromatic image is formed in such an apparatus, the triboelectric charge is not given in the primary transfer station because the black toner image transferred in the primary transfer station is immediately transferred onto the transfer material. Therefore, the toner image is not properly transferred, and a toner image of a character or the like is a transferred onto the transfer material immediately before the secondary transfer station with the result of improper image quality. This problem is remarkable particularly in such an image forming apparatus wherein the reverse transfer of the residual toner from the intermediary transfer member back to the photosensitive member and the primary transfer from the photosensitive drum to the intermediary transfer member for the next image, are carried out simultaneously.

SUMMARY OF THE INVENTION

Accordingly, it is a principal of the present invention to provide an image forming apparatus wherein when a toner image is transferred from an intermediary transfer member onto a transfer material, the toner image is prevented from scattering.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
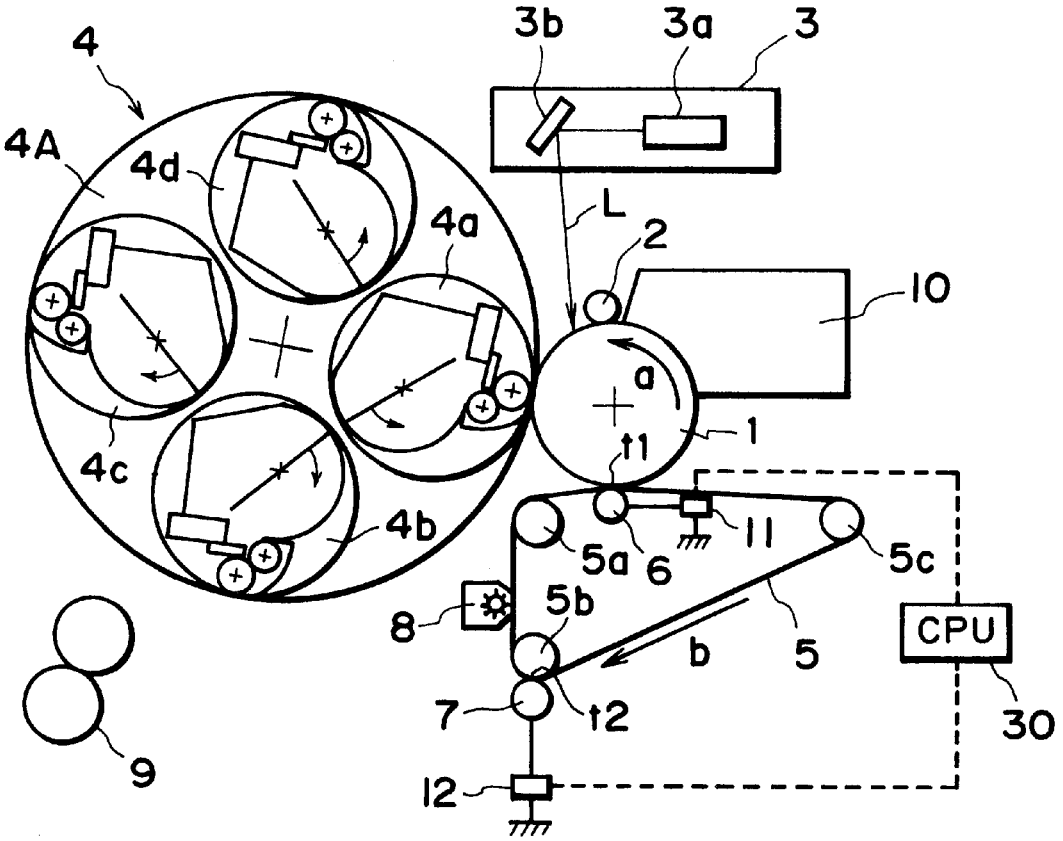
FIG. 1 is an illustration of an image forming apparatus according to a first embodiment of the present invention.
Figure 5:
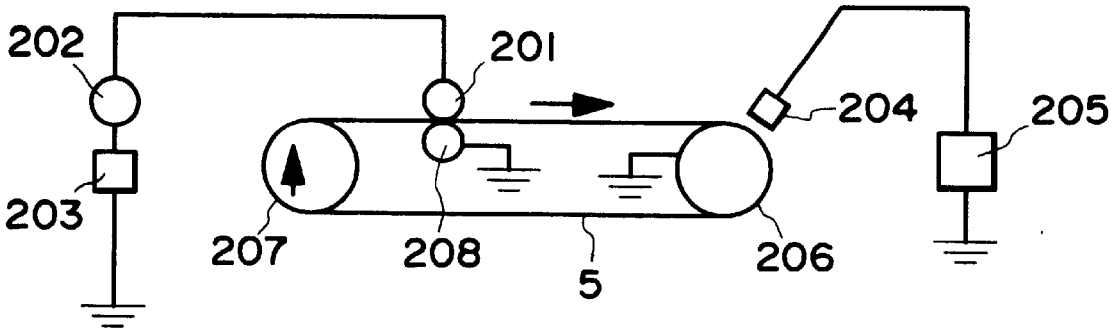
FIG. 5 shows a measuring device for measuring the of the intermediary transfer member.

FIG. 1 is a schematic drawing which depicts the general structure of an embodiment of the present invention in the form of an image forming apparatus. This image forming apparatus is enabled to form images in a full-color mode as well as in a monochrome mode. Its members which are the same as those in the conventional image forming apparatus illustrated in FIG. 5 are given the same referential characters as those in FIG. 5 to avoid descriptive repetition.

As shown in this drawing, along the peripheral surface of a photosensitive drum 1 as an image bearing member, there are disposed a charge roller 2, an exposing apparatus 3, a developing apparatus 4, an intermediary transfer belt 5, and a cleaning apparatus 10, in this order in terms of the rotational direction (indicated by a arrow mark a) of the photosensitive drum 1. The exposing apparatus 3 projects a laser beam upon the photosensitive drum 1. The intermediary transfer belt 5 constitutes the intermediary transfer member. The cleaning apparatus 10 cleans the photosensitive drum 1.

The photosensitive drum 1 comprises a cylindrical case member formed of aluminum or the like, and a photosensitive layer formed of photoconductive material coated on the peripheral surface of the base member. As for the photoconductive material, organic photoconductor, amorphous silicon, cadmium sulfate, selenium, and the like can be used. The photosensitive drum 1 is rotatively driven by a driving means (unillustrated) in the arrow a direction at a predetermined process speed.

The charge roller 2 is placed in contact with the peripheral surface of the photosensitive drum 1 to charge the photosensitive drum 1 to predetermined polarity (negative polarity in this apparatus) and potential level.

The exposing apparatus 3 exposes the peripheral surface of the photosensitive drum 1, which has been charged by the charging apparatus 2 to an exposing light L modulated with the inputted image formation data. More specifically, a laser beam L modulated with the inputted image formation data is outputted from the laser diode 3*a* of the exposing apparatus 3, and is reflected by a polygon mirror (unillustrated) and a reflection mirror 3*b* to expose the peripheral surface of the photosensitive drum 1. As a result, an electrostatic latent image reflecting the inputted image formation data is formed on the peripheral surface of the photosensitive drum 1.

The developing apparatus 4 develops the electrostatic latent image on the photosensitive drum 1. More specifically, the developing apparatus 4 comprises a magenta developing device 4*a*, a cyan developing device 4*b*, a yellow developing device 4*c*, and a black developing device 4*d*, which are mounted in a rotatively supported rotary 4A. As the rotary 4A is rotated, a specific developing device among the magenta developing device 4*a*, cyan developing device 4*b*, yellow developing device 4*c*, and black developing device 4*d*, which are to be used for developing the electrostatic latent image on the photosensitive drum 1, is positioned at a developing station where the peripheral surface of the specific developing device squarely faces the peripheral surface of the photosensitive drum 1, so that toner is adhered to the electrostatic latent image, in other words, the electrostatic latent image is developed (visualized).

The intermediary transfer belt 5 is wrapped around a driving roller 5*c*, a transfer roller 5*b* for the secondary transfer, and a tension roller 5*a*, being stretched with a tension of 4–8 kgf, and is moved in the direction indicated by an arrow mark b.

In a primary transfer station t1 in which the intermediary transfer belt 5 makes contact with the photosensitive drum 1, a transfer roller 6 (voltage applying means) for the primary transfer is disposed, pinching the intermediary transfer belt 5 between itself and the photosensitive drum 1. This transfer roller 6 for the primary transfer is connected to a primary transfer bias power source 11 (voltage applying means). On the opposite side from the transfer roller 5*b* through the intermediary transfer belt 5, a transfer roller 7 for the secondary transfer is disposed, forming a second transfer station t2 together with the transfer roller 5 for the secondary transfer. During the secondary transfer, the transfer roller 7 for the secondary transfer is pressed upon the intermediary transfer belt 5, with a piece of transfer medium (unillustrated) being pinched between the transfer roller 5 and the intermediary transfer belt 5. To the transfer roller 7 for the secondary transfer, a secondary transfer bias power source 12 is connected.

Between the transfer roller 5*b* for the secondary transfer and the tension roller 5*a*, a belt cleaning apparatus 8 is disposed in contact with the outward facing peripheral surface of the intermediary transfer belt 5 in order to remove from the intermediary transfer belt 5, the toner which remains on the intermediary transfer belt 5 after the secondary transfer.

To the primary transfer bias power source 11 and secondary transfer bias power source 12, a controlling apparatus 30 (CPU) as a controlling means is connected. The controlling apparatus 30 controls the transfer voltage for the primary transfer, which is applied from the primary transfer bias power source 11 to the transfer roller 6 for the primary transfer, and the transfer voltage for the secondary transfer, which is applied from the secondary transfer bias power source 12 to the transfer roller 7 for the secondary transfer (details will be described later). Also, the controlling apparatus 30 controls the switching between the full-color mode and the monochromatic mode.

Next, the image forming operation (in full-color mode) of the image forming apparatus structured as described above will be described.

First, the photosensitive drum 1 is uniformly charged by the charge roller 2, and an electrostatic latent image is formed as the charged photosensitive drum 1 is exposed to the laser beam L from the exposing apparatus 3. The electrostatic latent image formed on the photosensitive drum 1 is developed by a specific developing device, among the magenta developing device 4*a*, cyan developing device 4*b*, yellow developing device 4*c*, and black developing device 4*d*, which is correspondent to the latent image on the photosensitive drum 1. The developed image is transferred (primary transfer) onto the intermediary transfer belt 5. This process is carried out for each of the four colors (in this case, black, magenta, cyan, and yellow in this order) to place in layers four color images on the intermediary transfer belt 5.

As described before, in this embodiment, magnetic black toner, which is advantageous in terms of cost, is used as the black toner, and non-magnetic magenta, cyan, and yellow toners are used as the magenta, cyan, and yellow toners. The amount of electrical charge per unit weight of the black toner is smaller than that of the magenta, cyan, or yellow toner.

Next, the transfer roller 7 for the secondary transfer is placed in contact with the intermediary transfer belt 5, with a piece of transfer medium (unillustrated), that is, recording medium, being interposed between the intermediary transfer belt 5 and the transfer roller 7, and the color images are transferred (secondary transfer) all at once onto the piece of transfer medium. After the secondary transfer, the transfer medium is conveyed to a fixing apparatus 9, in which the four color toner images are fixed to the surface of the transfer medium through application of heat and pressure. Thereafter, the transfer medium is discharged from the fixing apparatus 9.

Next, the above-described primary and secondary transfer processes will be described in further detail.

(Primary Transfer Process)

When the photosensitive drum 1 is a photosensitive drum of a negatively chargeable photoconductor type, negatively chargeable toner is used to develop an electrostatic latent image (reversal development). Therefore, the transfer bias applied to the transfer roller 6 for the primary transfer by the primary transfer bias power source 11 is positive.

(Secondary Transfer Process)

In the transfer station t2 for the secondary transfer, the transfer roller 5*b* for the secondary transfer, which constitutes the opposing electrode, is grounded, and at the same time, transfer bias with positive polarity is applied to the transfer roller 7 for the secondary transfer by the secondary transfer bias power source 12. In this state, the color images on the intermediary transfer belt 5 are transferred onto a piece of transfer medium by passing the transfer medium through the secondary transfer station t2.

After the completion of the secondary transfer process, the toner (post-secondary transfer residual toner) which remains on the peripheral surface of the intermediary transfer belt 5 is removed by the intermediary transfer belt cleaning apparatus 8.

When the aforementioned image forming apparatus is used in monochromatic mode in which black (K) toner is used, a voltage level Vlm of the primary transfer voltage applied to the primary transfer roller 6 from the primary transfer bias power source 11 is switched by the controlling apparatus 30 to another voltage higher than a voltage level Vlf of the primary transfer voltage applied to the primary transfer roller 6 during the development of the first color (black) in the aforementioned full-color mode ($|Vlm|>|Vlf|$).

The above arrangement is made on the following premise.

The greater the amount of the toner in the toner image on the intermediary transfer belt, the greater the amount by which the toner scatters from the toner image on the intermediary transfer belt. In other words, the toner is most likely to scatter from the toner image when an image on the intermediary transfer belt is a linear image or a character, and has red, blue, or green color created by placing in layers two toners among Y, M and C toners: red (M toner+Y toner), blue (Y toner+C toner), or green (C toner+M toner). In addition, the greater the number of external disturbances such as the bending of the intermediary transfer belt which occurs while the toner image, having been transferred onto the intermediary transfer belt, is moved to the secondary transfer nip, or the deformation of the toner image which occurs in the primary transfer nip, the more liable the toner is to scatter. Thus, in order to reduce the number of the external disturbances which occur to the toner image formed of two different toners placed in layers, the image forming apparatus in this embodiment is configured so that the electrostatic latent image correspondent to black toner is first developed by the black toner, and then, the electrostatic latent images correspondent to the colors other than black color are developed by the color toners (Y, M and C toners in this order).

If the level of the primary transfer voltage is set high for the primary transfer of the black toner image, negative charge is accumulated on the surface of the intermediary transfer belt, across the areas onto which the second color toner and thereafter are to be transferred (primary transfer). As a result, a transfer voltage with a much higher level must be applied to the roller for the primary transfer in order to form barrier walls (FIG. 4) necessary to prevent the toner from scattering from the image formed of two color toners placed in layers. However, if the voltage level of the primary transfer bias voltage is higher than a certain level, there is a risk that electric discharge, which reduces image quality, will occur in the primary transfer station. A table given below shows the relationship between the optimum levels for the primary transfer voltage to be applied to the transfer roller for the first transfer to transfer (primary transfer) the toner images of the second color and thereafter while preventing the toner scattering, relative to various voltage levels of the primary transfer voltage to be applied to the transfer roller for the primary transfer roller to transfer (primary transfer) the toner of the first color, that is, the black toner, and the state of the image degradation caused by the aforementioned electrical discharge. In the test, the potential levels on the photosensitive drum, across the dark areas (potential level to which photosensitive drum is charged by charge roller) and the light portion (exposed portion), were −500 V and −150 V, respectively. Also in the table, "G" and "N" indicate the state of image degradation, wherein "G" represents excellent image quality, that is, occurrence of no image degradation, whereas "N" represents low image quality, that is, occurrence of image degradation.

TABLE 1

| | | | | | |
|---|---|---|---|---|---|
| 1ST CLR 1RY BIAS (V) | 100 | 200 | 300 | 400 | 500 |
| 2ND CLR 1RY BIAS (V) | 300 | 350 | 400 | 700 | 800 |
| 3RD CLR 1RY BIAS (V) | 500 | 550 | 700 | 1000 | 1200 |
| 4TH CLR 1RY BIAS (V) | 700 | 750 | 1000 | 1300 | 1500 |
| IMAGE QUALITY | G | G | G | N | N |

As is evident from Table 1 in order to prevent both the image degradation and toner scattering traceable to the electrical discharge, the voltage level of the primary transfer voltage to be applied for the first color, or black, in the full-color mode is desired to be set at approximately 300 V or below at which the aforementioned negative electrical charge is scarcely accumulated on the intermediary transfer belt.

On the other hand, when an image formed of the black toner is transferred (primary transfer) in the monochromatic mode, it is unnecessary, unlike in the full-color mode in which the intermediary transfer belt is charged up, to prevent the occurrence of the necessity that the primary transfer voltage for the second color and thereafter must be increased to desirably transfer the toner images of the second color and thereafter. Therefore, it is unnecessary to keep the primary transfer voltage at a low level. Table 2 given below shows the level of the toner scattering from black characters in the monochromatic mode, and the level of the primary transfer efficiency for black characters.

TABLE 2

| | K CHAR SCATTER | K CHAR 1RY TRANSFER EFFICIENCY |
|---|---|---|
| Ref | G | G |
| 100 | N | F |
| 200 | N | G |
| 300 | N | G |
| 400 | F | G |
| 500 | F | G |
| 600 | G | G |
| 900 | G | G |
| 1200 | G | F |
| 1500 | G | N |

In Table 2, "Ref" represents the level of the scattering of the black toner, and the level of the transfer efficiency for the black toner, in the full-color mode (primary transfer voltage was set at 150 V for first color (K), 550 V for second color (M), 650 V for third color (C), and 650 V for fourth color (Y)). In this test, the dark portion potential level (potential level to which photosensitive drum is charged by charge roller) was −500 V, and the light portion potential level (potential level at exposed portion) was −150 V. In the toner scattering line in Table 2, "G" means that the toner scattering scarcely occurred; "F" means that the toner scattering occurred at a level with no practical problem; and "N" means that the toner scattering occurred at an unignorable level. In the transfer efficiency line in Table 2, "G" means that the transfer efficiency was close to 100%; "F" means that the transfer efficiency fell to a level at which the resultant image had no problem in practical terms; and "N" means that unignorable problems, for example, a problem that the resultant image was too light, occurred.

As is evident from Table 2, in order to maintain the transfer efficiency at a high level in the monochromatic mode while preventing the toner scattering from black characters, the voltage level of the primary transfer voltage is desired to be set at a level within an range approximately from 400 V to 1200 V.

In the full-color mode, while the black toner image passes through the primary transfer station t1 during the transfers of the toner images of the second color and thereafter, it is electrically charged due to the difference between the potential level of the peripheral surface of the photosensitive drum 1 and the potential level of the primary transfer voltage. On the other hand, in the monochromatic mode, the areas on the photosensitive drum 1, on which the black toner is present, are the exposed areas of the photosensitive drum 1. Therefore, the difference between the potential level of the black image and the potential level of the primary transfer voltage is substantially smaller.

Consequently, it is less likely that the black toner image is electrically charged. Thus, the voltage level of the primary transfer voltage in the monochromatic mode is raised compared to the full-color mode, increasing thereby the difference between the potential level on the exposed area and the potential level of the primary transfer voltage, so that electrical charge is given to the black toner image and the potential level of the black toner image is raised to the level equal to that in the full-color mode.

As described above, in this embodiment, the voltage level of the primary transfer voltage applied in the monochromatic mode is made higher than the voltage level of the primary transfer voltage applied for the first color (black) in the full-color image, so that the toner is prevented from scattering when forming a linear image such as an image of a letter or character.

Embodiment 2

Figure 2:
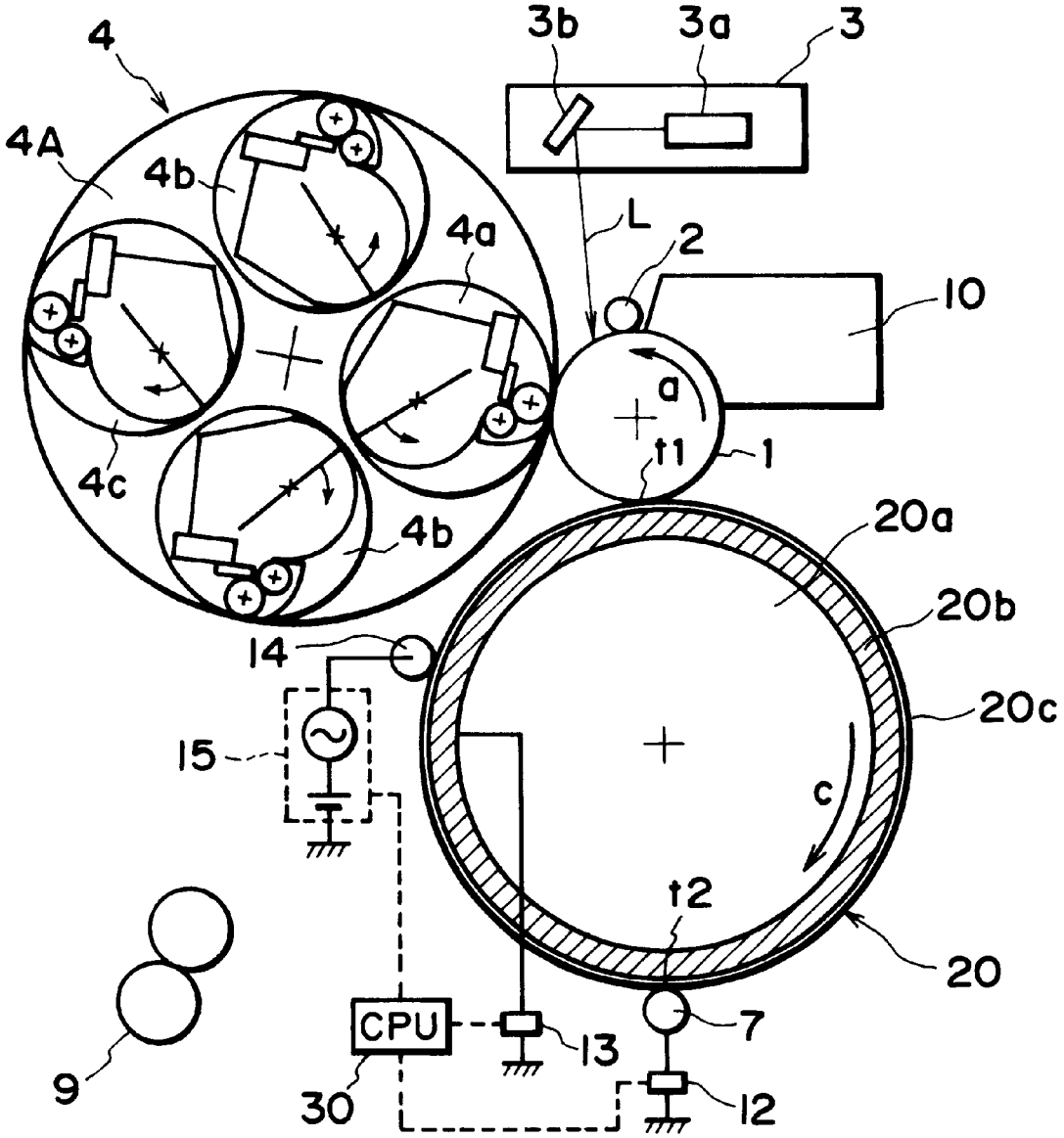
FIG. 2 is an illustration of an image forming apparatus according to a second embodiment of the present invention.

FIG. 2 is a schematic drawing which depicts the general structure of the image forming apparatus in another embodiment of the present invention. In the drawing, the same members as those in the first embodiment are given the same referential characters as those in the first embodiment illustrated in FIG. 1, in order to avoid repeating the same descriptions.

In this embodiment, an intermediary transfer drum 20 is used as the intermediary transfer member. Otherwise, the structure of the image forming apparatus in this embodiment is substantially the same as that of the image forming apparatus in the first embodiment.

The intermediary transfer drum 20 consists of an aluminum cylinder 20*a*, an elastic resistive layer 20*b*, and a cover layer 20*c*. The elastic resistive layer 20*a* is formed of NBR rubber in which carbon particles are dispersed to give the NBR rubber an electrical resistance in the medium range. It is formed on the peripheral surface of the aluminum cylinder 20*a*. The cover layer 20*c* is an approximately 30 $\mu$m thick urethane resin, and is formed on the elastic resistive layer 20*b*. To the intermediary transfer drum 20, a primary transfer bias power source 13 as the voltage applying means is connected.

On the peripheral surface of the intermediary transfer drum 20, there is provided a charging apparatus 14 which is in the form of a roller and cleans the intermediary transfer drum 20. To the charging apparatus 14, a charge bias power source 15 is connected. The charge bias power source 15 applies to the charging apparatus 14, a compound bias composed of DC voltage and AC voltage.

A controlling apparatus 30 controls three voltages; the primary transfer voltage which is applied to the intermediary transfer drum 20 from the primary transfer bias power source 13; the secondary transfer voltage which is applied to the transfer roller 7 for the secondary transfer from the secondary transfer bias power source 12; and the cleaning bias (voltage) which is applied to the charging apparatus 14 from the charge bias power source 15. Also in this embodiment, voltage level is switched by the controlling apparatus 30 so that the level of the primary transfer voltage applied in the monochromatic mode is rendered higher than the level of the primary transfer voltage applied for the first color (black) in the full-color mode, as in the first embodiment.

If a system which cleans the intermediary transfer member (intermediary transfer belt or intermediary transfer drum) by mechanically scraping off the residual toner remaining on the intermediary transfer member after the secondary transfer with the use of a blade, a fur brush, or the like is employed, it is necessary to increase the pressure with which a blade or the like is placed in contact with the intermediary transfer member, or to increase the rotational velocity of a fur brush or the like, so that satisfactory scraping capacity is assured. Therefore, there is a risk that the intermediary transfer member, and the cleaning member itself such as a blade or a fur brush, are subjected to premature wear, mechanical damage, or the like problems.

Further, in recent years, the number of the apparatuses which employ toner composed of ultramicroscopic particles or spherical polymer particles to improve image quality has been increasing. Also it has become evident that when toner for producing an image of such a high quality as required in recent years is used, the toner escapes the scraping means, and therefore, the post-secondary transfer residual toner cannot be sufficiently cleaned.

Thus, cleaning systems different from the conventional cleaning systems have been proposed. For example, Japanese Laid-Open Patent Application Nos. 303310/1993 and 105980/1989 disclose a system which electrically disposes of the post-secondary transfer residual toner by applying electrical voltage to a cleaning member.

Next, this system will be described in detail. While the toner is transferred from the intermediary transfer drum onto a piece of transfer medium, the toner is subjected to a strong electrical field, the polarity of which is opposite to the normal polarity (negative polarity in this embodiment) to which the toner has been changed. Therefore, a substantially large portion of the post-second transfer residual toner remaining on the intermediary transfer drum has been charged to the polarity (positive polarity in this embodiment) opposite to the normal polarity. However, some of the post-secondary transfer residual toner has been neutralized and does not have any charge, or still has negative polarity.

Thus, in this embodiment, immediately after the secondary transfer, a bias composed of a DC component and an AC component is applied as the cleaning bias from the charge bias power source 15 to the charging apparatus 8 which is in contact with the intermediary transfer drum. With this arrangement, the post-secondary transfer residual toner is caused to move back and forth, by the AC component of this cleaning bias, being thereby more uniformly charged to the positive polarity. After being charged to the positive polarity, the post-secondary transfer residual toner is transferred back onto the photosensitive drum 1, in the primary transfer nip t1; the intermediary transfer drum 20 is cleaned.

Further, event during continuous printing, the electrical charge of the post-secondary transfer residual toner on the intermediary transfer drum, which has been charged to the polarity opposite to the normal toner polarity, and the electrical charge of the normal toner on the photosensitive drum 1, which is transferred (primary transfer) onto the intermediary transfer drum, do not neutralize each other because the contact between the post-secondary transfer residual toner to be transferred onto the photosensitive drum 1 and the normally charged toner to be transferred onto the intermediary transfer drum is very brief. Therefore, the post-secondary transfer residual toner, which has been charged to the polarity opposite to the normal polarity, is transferred onto the photosensitive drum 1, and the following toner image, which has been charged to the normal polarity, is transferred onto the intermediary transfer drum 20, in the primary transfer nip t1. Consequently, the post-secondary transfer residual toner is not transferred onto the piece of transfer medium during the printing of the following print; a print of desirable quality is outputted.

When a system which employs an intermediary transfer drum as the intermediary transfer member as in this embodiment, the polarity on the counter electrode side of the charging apparatus 14 for cleaning inevitably becomes the same as the polarity of the primary transfer voltage. Therefore, if the level of the primary transfer voltage applied in the monochromatic mode is rendered higher than the level of the primary transfer voltage applied for the first color in the full-color mode, and the potential level of the DC component of the cleaning bias is left the same as that in the full-color mode, a condition similar to the condition which occurs when the potential level of the DC component of the cleaning bias is lowered in monochromatic mode occurs. As a result, the post-secondary transfer residual toner is less likely to be satisfactorily charged to the positive polarity by the charging apparatus 8.

Thus, in this embodiment, control is executed by the controlling apparatus so that the potential level Vlm of the primary transfer voltage applied for the first color in the full-color mode, the potential level Vlm of the primary transfer voltage applied in the monochromatic mode, the potential level Vdf of the DC component of the cleaning bias applied to the charging apparatus 8 from the charge bias power source 15 in the full-color mode, and the potential level Vcm of the DC component of the cleaning bias applied to the charging apparatus 8 from the charging bias power source 15 in the monochromatic mode, satisfy the following requirement:

$|Vcm|>|Vcf|$.

The results of a cleaning test for the intermediary transfer drum 20, in which (Vlm−Vlf) was kept at 600 V, and δVc (=Vcm−Vcf) was varied, are given Table 3.

TABLE 3

| δVc (V) | 0 | 200 | 400 | 600 | 800 |
|---|---|---|---|---|---|
| CLEANING | N | F | F | G | G |

In the table, "G" means that the cleaning performance was at the normal level. "F" means that the cleaning performance was slightly below the normal level; and "N" means that the cleaning performance was at an undesirable level.

As is evident from the results given in Table 3, the cleaning performance could be improved by satisfying the requirement |Vcm|>|Vcf|.

Embodiment 3

Figure 3:
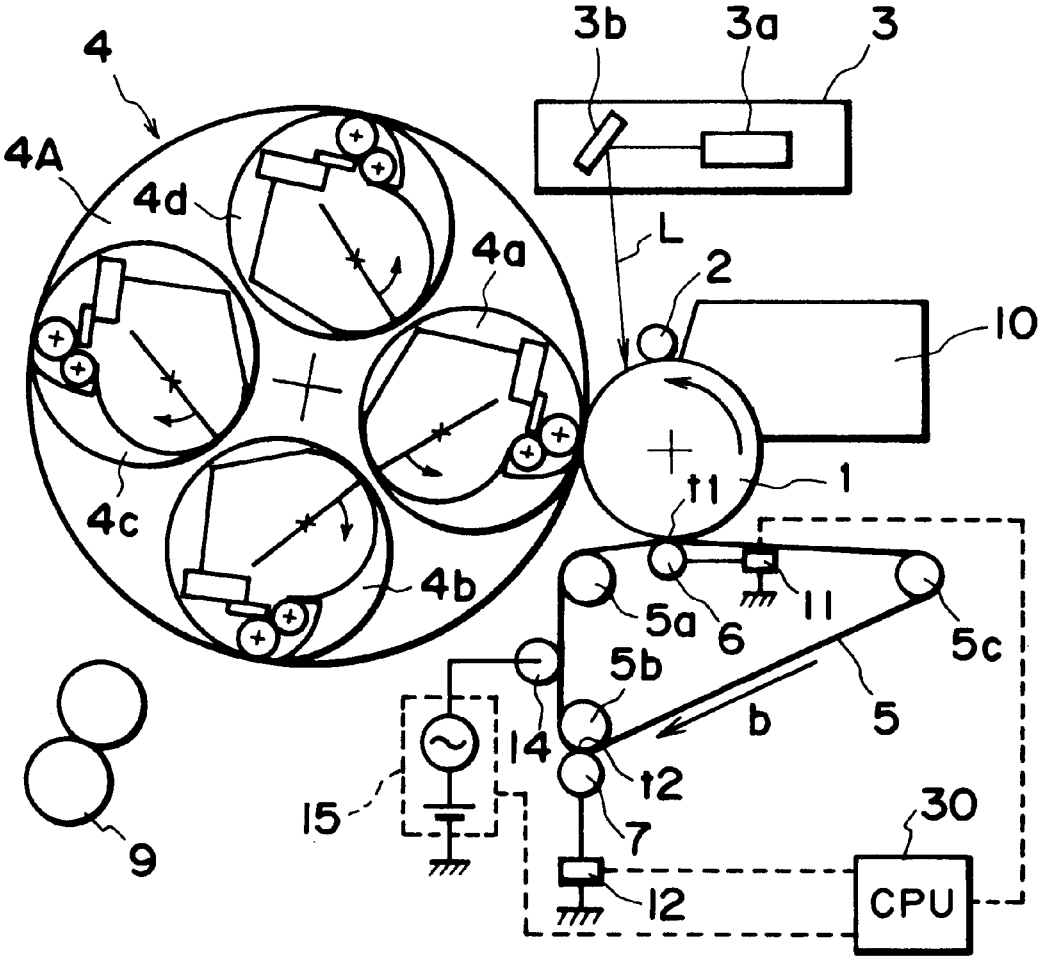
FIG. 3 is an illustration of an image forming apparatus according to a third embodiment of the present invention.

FIG. 3 is a schematic drawing which depicts the general structure of the image forming apparatus in this embodiment. In the drawing, the same members as those of the image forming apparatus in the first embodiment depicted in FIG. 1 are given the same referential characters as those in FIG. 1, so that the repetition of the same descriptions can be avoided.

In this embodiment, the intermediary transfer belt 5 of the image forming apparatus in the first embodiment depicted in FIG. 1 is cleaned by the charging apparatus 14 described in the second embodiment. Otherwise, the structure of the image forming apparatus in this embodiment is the same as that in the first embodiment.

A controlling apparatus 30 controls three voltages; the primary transfer voltage, which is applied to the intermediary transfer belt 5 from the primary transfer bias power source 11; the secondary transfer voltage which is applied to the transfer roller 7 for the secondary transfer from the secondary transfer bias power source 12; and the cleaning bias (voltage) which is applied to the charging apparatus 14 from the charge bias power source 15. Also in this embodiment, voltage level is controlled by the controlling apparatus 30 so that the level of the primary transfer voltage applied in the monochromatic mode is rendered higher than the level of the primary transfer voltage applied for the first color (black) in the full-color mode, as in the first and second embodiments.

The intermediary transfer belt 5 employed in this embodiment uses a rubber base layer in order to improve the mechanical strength of the intermediary transfer belt 5. However, when rubber is used as the material for the base layer for the intermediary transfer belt 5, the intermediary transfer belt 5 slightly extends or contracts at the points of contact between the intermediary transfer belt 5 and the three rollers; driving roller 5*c,* counter roller 5*b* for the secondary transfer, and tension roller 5*a,* around which the intermediary transfer belt 5 is wrapped. Therefore, the toner is more likely to scatter from the toner image on the intermediary transfer belt 5.

At this time, the mechanism of the toner scattering from the toner image, which occurs on the intermediary transfer belt 5, will be briefly described along with a method for preventing the toner scattering. The description will be given with reference to an image of a red letter. A red letter is created as a letter formed of yellow toner is first transferred onto the intermediary transfer belt 5, and then, a letter formed or magenta toner is transferred in layers upon he letter formed of yellow toner on the intermediary transfer belt 5.

Figure 4:
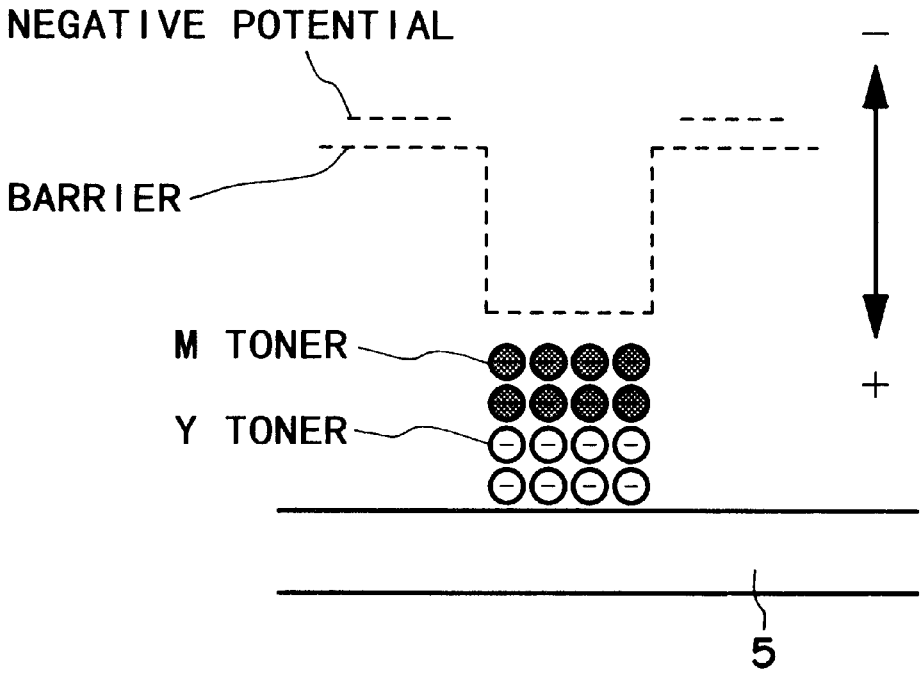
FIG. 4, (*a*) shows toner particles on the surface of the intermediary transfer member in the case that the potential retaining period is long, (*b*) shows toner particles on the surface of the intermediary transfer member in the case that the potential retaining period is short.
Figure 4:
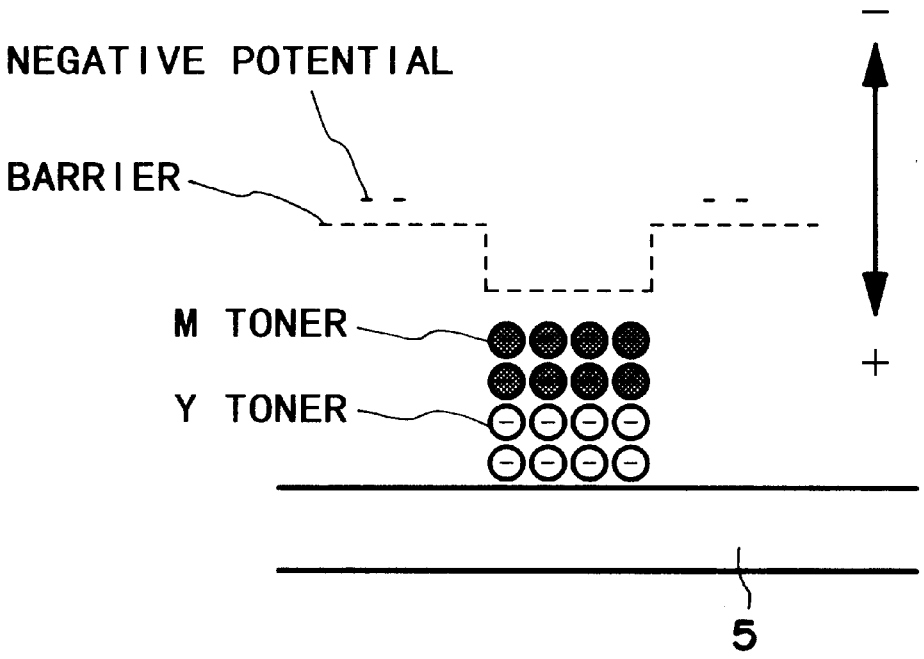

During the formation of a red letter on the intermediary transfer belt 5, walls (barriers) of electrical charge are also formed on the intermediary transfer belt 5 by the negative electrical charge which has transferred from the photosensitive drum 1 onto the intermediary transfer belt 5, as illustrated in FIG. 4, (*a*). When the electrical resistance of the intermediary transfer belt 5 is high enough to enable the intermediary transfer belt 5 to retain the electrical potential for a certain length of time (τ), these walls of the electrical charge are maintained until the secondary transfer. As a result, the red letter formed on the intermediary transfer belt 5 is transferred (secondary transfer) onto a piece of transfer medium without being scattered.

However, when the electrical resistance of the intermediary transfer belt 5 is not high enough to enable the intermediary transfer belt 5 to retain the electrical charge for a certain length of time (τ), the walls of the electrical charge formed in the primary transfer station t1 become low as illustrated in FIG. 4, (*b*), before the secondary transfer. As a result, the toner of the red letter formed on the intermediary transfer belt 5 is scattered by the external disturbances, for example, the bending of the intermediary transfer belt 5 at the contacts between the intermediary transfer belt 5 and the three rollers; the intermediary transfer belt driving roller 5*c,* counter roller 5*b* for the secondary transfer; and tension roller 5*a,* or the deformation of the intermediary transfer belt 5 in the nip portion (primary transfer station t1) between the photosensitive drum 1 and the intermediary transfer belt 5.

In other words, the toner scattering can be prevented by employing, as the intermediary transfer belt 5, such a belt that meets the following requirement:

$T \leqq \tau \leqq 500$.

T (sec) stands for the time it takes for the belt to rotate once during a transfer operation, and τ stands for the time (potential retention time) it takes for the electrical potential of the peripheral surfaces of the belt to attenuate to 1/e (e=2.71828) after the belt is charged to a predetermined potential level.

At this time, a method for measuring τ will be described.

Figure 6:
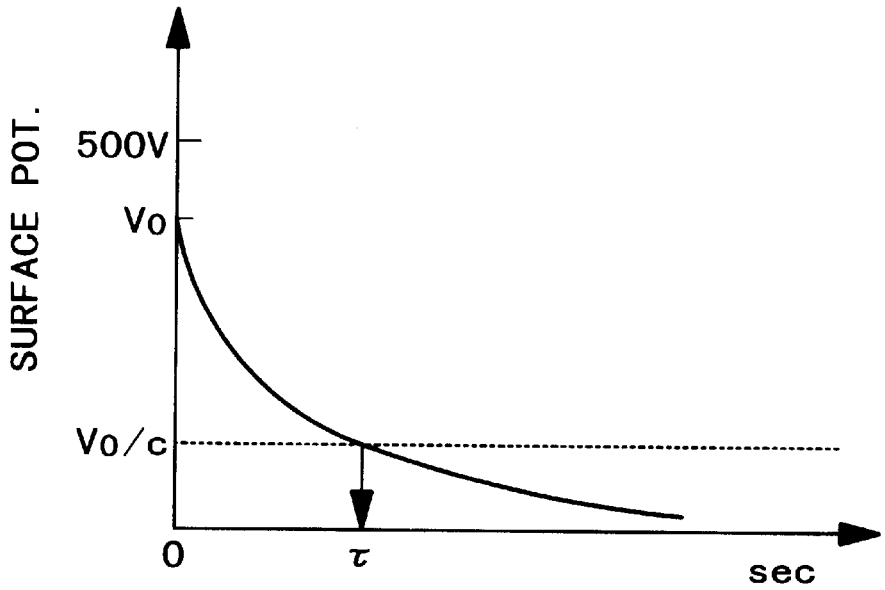
FIG. 6 is an attenuation curve of the surface potential of the intermediary transfer member.
Figure 7:
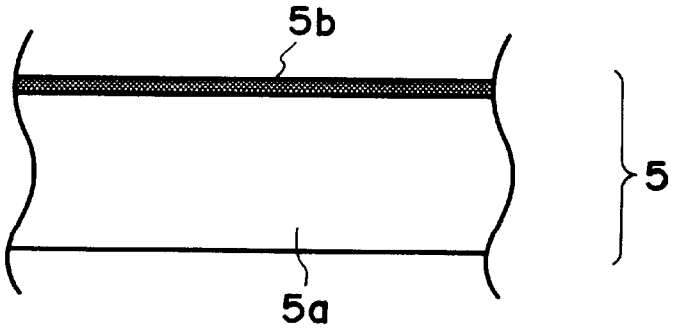
FIG. 7 shows a layer structure of the intermediary transfer belt.
Figure 8:
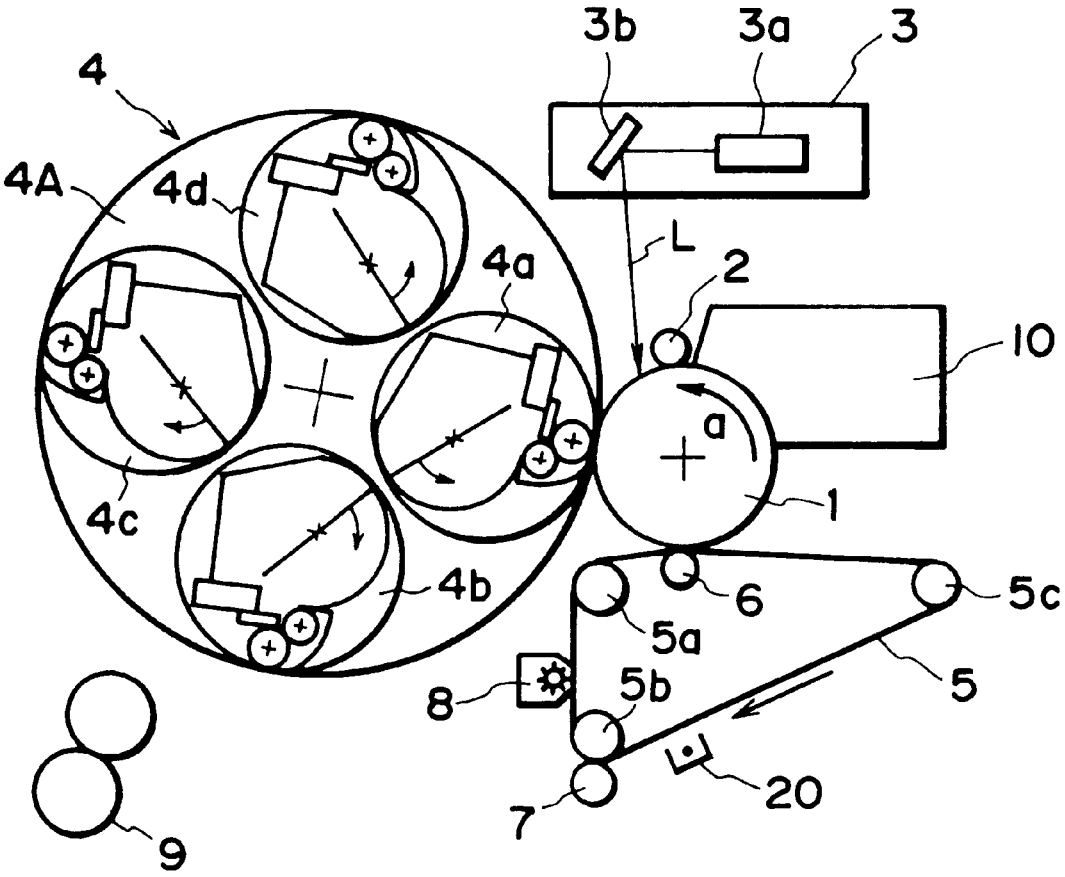
FIG. 8 PRIOR ART
FIG. 8 shows an example of a conventional image forming apparatus.

Referring to FIG. 5, the intermediary transfer belt 5 is wrapped around a driving roller 207 and a metallic tension roller 206 as the parts of the measurement jigs, and is rotated in the direction indicated by an arrow mark at approximately 10.0 cm. The intermediary transfer belt 5 is pinched between a charge roller 201 and a metallic counter roller 208, and is charged by an AC power source 202 with a peak-to-peak voltage Vpp of approximately 3 kV and a DC power source 203 with a voltage of +500 V. The surface potential level of the intermediary transfer belt 5 charged by the charge foller 201 is measured by the probe 204 and main assembly 205 of a surface potential meter, at a point approximately 10 cm (equivalent to one second after charging of intermediary transfer belt) downsteam, in terms of the moving direction of the intermediary transfer belt 5, from the charging point. After the surface potential level of the intermediary transfer belt 5 stabilizes, the driving of the intermediary transfer belt 5 by the driving roller 207 and the charging of the intermediary transfer belt 5 are stopped. Then, the attenuation of the surface potential level of the intermediary transfer belt 5 is measured. FIG. 6 shows the results of the measurement of τ. In FIG. 6, VO stands for the surface potential level at the moment when the intermediary transfer belt 5 was stopped, and τ stands for the time it look for the potential level VO to attenuate to VO/e (e=2.781828).

All that is necessary to enable the intermediary transfer belt 5 to easily retain the negative charge from the photosensitive drum so that the potential retention time τ becomes longer is to employ, as the intermediary transfer belt 5, a belt with a volumetric resistivity of approximately $10^8$–$10^{18}$ ohm·cm and a thickness of 2–100 μm. In this embodiment, in order to improve the durability of the intermediary transfer belt 5, the intermediary transfer belt 5 is constituted of a base layer 5*a* formed of rubber and a surface layer 5*b* formed of resin. The electrical resistance of the base layer 5*a* is rendered low, and the electrical resistance of the surface layer 5*b* is rendered high. More specifically, the base layer 5*a* is 0.3–2 mm thick, and is formed of such rubber as acrylonitrile-butadiene rubber (NBR), styrene-butadiene rubber, butadiene rubber, ethylene-propylene rubber, chloroprene rubber, chlorosulfonated polyethylene, chlorinated polyethylene, acrylic rubber, fluorinated rubber, urethane rubber, on the like, the volumetric resistivity of which as been adjusted to $10^4$–$10^8$ ohm·cm (low resistance). The surface layer 5*b* is 2–100 μm thick, and is formed on the base layer 51*a*. It is formed of rubber or such resin as PVdF, PET, polycarbonate, polyethylene, silicon, or the like, the volumetric resistivity of which has been adjusted to $10^8$–$10^{18}$ ohm·cm (high resistance).

Since the electrical resistance of the base layer of the intermediary transfer belt 5 is low, the potential level of the counter electrode of the charging apparatus 14 becomes the same as that of the primary transfer voltage. Further, since the electrical resistance of the surface layer of the intermediary transfer belt 5 is rendered high so that the electrical charge can be easily retained, it is extremely easily charged.

In other words, when the voltage level Vlm of the primary transfer voltage applied in the monochromatic mode is rendered higher than the voltage level Vlf of the primary transfer voltage applied for the first color in the full-color mode, if the voltage level of the DC component in the cleaning bias applied to the charging apparatus 14 in the monochromatic mode is left the same as that in the full-color mode, a condition similar to the condition which occurs as the potential level of the DC component of the cleaning bias is lowered in the monochromatic mode occurs, which makes it difficult to satisfactorily charge the post-secondary transfer residual toner to the positive polarity by the charging apparatus 14. In addition, when the potential level of the DC component of the cleaning bias is simply raised, the potential level of the intermediary transfer belt 5 does not become 0 V after passing through the charging apparatus 14. As a result, the image degradation occurs.

Thus, in this embodiment, control is executed by a controlling apparatus 30 so that the potential level Vlf of the primary transfer bias applied for the first color in the full-color mode, the potential level Vlm of the primary transfer voltage applied in the monochromatic mode, the potential level Vcf of the DC component of the cleaning bias in the full-color mode, and the potential level Vcm of the DC component of the cleaning bias in the monochromatic mode, satisfy the following requirements:

$$Vcm-Vcf=Vlm-Vlf.$$

As a result, after passing though the charging apparatus 14, the surface potential level of the intermediary transfer belt 5 becomes substantially zero volt. Consequently, the scattering of the toner from the toner image is prevented, assuring that desirable images are outputted.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image;

an intermediary transfer member;

voltage application means for applying a voltage to said intermediary transfer member to electrostatically transfer the toner image from said image bearing member onto said intermediary transfer member at an image transfer position, the toner image transferred onto said intermediary transfer member being transferred onto a transfer material;

wherein said apparatus is operable selectively in a first mode in which toner images of different colors are sequentially and superposedly transferred from said image bearing member onto said intermediary transfer member by said voltage application means, and are then transferred onto the transfer material, and in a second mode in which only a toner image of a first color of the different colors is transferred onto said intermediary transfer member from said image bearing member by said voltage application means, only the toner image of the first color being transferred onto the transfer material;

wherein an absolute value of the voltage applied to said intermediary transfer member by said voltage application means is larger when said second mode is selected than when said first mode is selected, when the toner image of said first color is transferred from said image bearing member onto said intermediary transfer member.

2. An apparatus according to claim 1, further comprising charging means for charging residual toner remaining on said intermediary transfer member after the toner image is transferred from said intermediary transfer member onto the transfer material.

3. An apparatus according to claim 2, wherein said charging means is movable toward and away from said intermediary transfer member.

4. An apparatus according to claim 2, wherein said charging means charges the residual toner to a polarity opposite from a regular polarity of the toner.

5. An apparatus according to claim 4, wherein said charging means is supplied with a DC biased AC voltage during its charging operation.

6. An apparatus according to claim 4, wherein an electrical field effective to transfer a next toner image from said image bearing member onto said intermediary transfer member is formed in said transfer position, simultaneously with transfer of the residual toner charged by said charging means from said intermediary transfer member onto said image bearing member.

7. An apparatus according to claim 6, wherein electric field is formed by said voltage application means.

8. An apparatus according to claim 6, wherein the voltage applied to said charging means is larger when the second mode is selected then when said first mode is selected.

9. An apparatus according to claim 6, wherein said intermediary transfer member includes a base layer having a volume resistivity of $10^4$ to $10^8$ Ohm·cm and a surface layer having a volume resistivity of $10^8$ to $10^{18}$.

10. An apparatus according to claim 9, wherein a difference between the voltage applied to said intermediary transfer member by said voltage application means and the voltage applied to said charging means when the first mode is selected is equal to the difference between the voltage applied to the intermediary transfer member by said voltage application means when the second mode is selected and the voltage applied to said charging means when the second mode is selected .

11. An apparatus according to claim 1, wherein an amount of electric charge per unit weight of the toner of the first color is smaller than that of another toner.

12. An apparatus according to claim 11, wherein the toner of the first color is magnetic toner.

13. An apparatus according to claim 12, wherein the toner image of the first color is a black toner image.

14. An apparatus according to claim 1, wherein said intermediary transfer member has a volume resistivity of $10^8$ to $10^{18}$ Ohm·cm.

15. An apparatus according to claim 14, wherein said the intermediary transfer member includes a base layer having a volume resistivity of $10^4$ to $10^8$ Ohm·cm and a surface layer having a volume resistivity of $10^8$ to $10^{18}$ Ohm·cm.

16. An apparatus according to claim 14, wherein when the second mode is selected, an absolute value of the voltage applied to said intermediary transfer member by said voltage application means is not smaller than 400 V and not larger than 1200 V.

17. An apparatus according to claim 16, wherein when the first mode is selected, an absolute value of the voltage applied to said intermediary transfer member by said voltage application means is not larger than 300 V.

18. An apparatus according to claim 1, wherein a rotation period of said intermediary transfer member T (sec), a time (t) elapsing from stop of voltage application to said the intermediary transfer member to instance when a voltage V of said intermediary transfer member one second after application of a predetermined voltage becomes V/e, satisfy:

$T \leqq t \leqq = 500(\text{sec})$ where e is a base of natural logarithm (e=2.71828 . . .).

19. An apparatus according to claim 18, wherein when the second mode is selected, an absolute value of the voltage applied to said intermediary transfer member by said voltage application means is not smaller than 400 V and not larger than 1200 V.

20. An apparatus according to claim 19, wherein when the first mode is selected, an absolute value of the voltage applied to said intermediary transfer member by said voltage application means is not larger than 300 V.

21. An apparatus according to claim 1, further comprising transfer means for electrostatically transferring the toner image from said intermediary transfer member to the transfer material.

22. An apparatus according to claim 21, wherein when the toner image is transferred onto the transfer material, the transfer material is passed between said transfer means and said intermediary transfer member, and said transfer means is supplied with a voltage.

23. An apparatus according to any one of claims 1–22, wherein a charging polarity of said image bearing member and a regular charging polarity of the toner are the same.

* * * * *

UNITED STATES PATENT AND TRADEMARK OFFICE

CERTIFICATE OF CORRECTION

PATENT NO. : 6,151,476

DATED : November 21, 2000

INVENTOR(S): TAKAAKI TSURUYA, ET AL.

It is certified that error appears in the above-identified patent and that said Letters Patent is hereby corrected as shown below:

COLUMN 1:
Line 3, "this" should read --is--.
Line 24, "of" (2nd occurrence) should be deleted.

COLUMN 2:
Line 62, "the" (2nd occurrence) should be deleted.

COLUMN 3:
Line 2, "a" should be deleted.
Line 37, "of the" should be deleted.

COLUMN 8:
Line 10, "an" should read --a--.

COLUMN 10:
Line 56, "given" should read --given in--.

COLUMN 11:
Line 51, "he" should read --the--.

COLUMN 14:
Line 66, "the" should be deleted.

UNITED STATES PATENT AND TRADEMARK OFFICE

CERTIFICATE OF CORRECTION

PATENT NO. : 6,151,476

DATED : November 21, 2000

INVENTOR(S): TAKAAKI TSURUYA, ET AL.

It is certified that error appears in the above-identified patent and that said Letters Patent is hereby corrected as shown below:

COLUMN 15:
Line 14, "stop" should read --a stop--.
Line 15, "to" should read --to an--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*